United States Patent [19]

Stewart

[11] Patent Number: 4,856,135

[45] Date of Patent: Aug. 15, 1989

[54] MASONRY TOOL

[75] Inventor: Jon K. Stewart, Reno, Nev.

[73] Assignee: AusTek, Inc., Reno, Nev.

[21] Appl. No.: 164,978

[22] Filed: Mar. 7, 1988

[51] Int. Cl.[4] ..... E04F 21/165

[52] U.S. Cl. ..... 15/105.5; 15/235.3; 30/125; 30/170; 30/172

[58] Field of Search ..... 15/235.3, 105.5; 30/169, 170, 172, 125

[56] References Cited

U.S. PATENT DOCUMENTS

| | | | |
|---|---|---|---|
| 918,967 | 4/1909 | Close | 30/169 X |
| 1,142,065 | 6/1915 | Stephenson | 15/105.5 |
| 1,195,297 | 8/1916 | Vlchek | 30/169 |
| 1,445,021 | 2/1923 | Johnson | 15/105.5 |
| 1,511,807 | 10/1924 | Garner et al. | 15/105.5 |
| 2,306,083 | 12/1942 | Rioux | 30/125 X |
| 3,237,235 | 3/1966 | Moody | 15/235.3 |
| 3,662,423 | 5/1972 | Miller | 15/235.3 |
| 4,432,115 | 2/1984 | Fehler | 15/105.5 |
| 4,682,383 | 7/1987 | Brenish et al. | 15/105.5 |

FOREIGN PATENT DOCUMENTS

| | | | |
|---|---|---|---|
| 496236 | 9/1953 | Canada | 15/235.3 |

OTHER PUBLICATIONS

"Bent Nail Rakes Mortar Deep and Square", American Builder, p. 112, Aug. 1965.

*Primary Examiner*—Frank T. Yost
*Assistant Examiner*—Eugenia A. Jones
*Attorney, Agent, or Firm*—Thorpe, North & Western

[57] ABSTRACT

A masonry tool for raking unhardened mortar at the predetermined depth between courses of brick at either open wall locations or within tight corners. This tool comprises an elongated handle having an upper side and a lower side, the forward and terminal ends. A rake and carriage assembly is attached to the foward end and provides a pair of wheels oriented for movement along a line substantially parallel with the handle axis. This carriage includes a first raking device which extends beyond a rim of the wheels such that a terminal portion of the raking device may project into a joint separating adjacent bricks as the wheels roll across an exposed face thereof. A second raking device is attached at the terminal end of the handle and projects upward with respect to the upper side to substantially the same predetermined depth as that depth provided with the first raking device. The user is thereby enabled to insert the second raking device into corner locations or other areas of spacial constraint to remove loose mortar not otherwise accessible because of the carriage assembly.

11 Claims, 2 Drawing Sheets

MASONRY TOOL

BACKGROUND OF THE INVENTION

1. Field of Invention

This invention relates to a masonry tool which is specially adapted for extracting loose mortar from between courses of brick at wall corners and locations of restricted space. More particularly, the present invention relates to a combination mason tool for extracting loose mortar between courses of brick either along an open wall area or in a tight corner.

2. Prior Art

The art of bricklaying has existed for thousands of years and has experienced relatively little modification, particularly during the last fifty years. Most techniques of bricklaying are well known and are generally applied within the construction industry which is a very competitive field of commerce. As a consequence, the success of one mason over another depends in large part upon his skill level and ability to work efficiently. Indeed, the skilled mason who is able to work quickly will not only be in the best position to increase his profits, but will also have greater flexibility in competing for specific jobs.

A variety of tools have been formulated to assist the mason in streamlining bricklaying procedures. For example, U.S. Pat. No. 4,682,383 by Brenish discloses a combination joint rake and jointer tool for raking loose mortar from between courses of brickwork at the joint and for smoothing the mortar. This tool consists of an elongated tool body with an attached sled bar which slides within the joint and flattens the loose mortar to a smooth finish. This sled bar slides along the joint as it follows a rake and carriage assembly comprising a pair of wheels and a projecting nail head which is affixed in length to project within the joint to a predetermined depth. The mason places this nail head within a brick joint and with the pair of wheels on opposing sides thereof. The tool is pushed along the joint with the wheels riding along the faces of brick on opposite sides of the joint. The nail head operates to drag loose mortar free of the joint and to dig away mortar to the desired depth. The sled bar rides within the joint after removal of such mortar to smooth the remaining mortar to a desired finish. Variations of this more recent tool design can be found in U.S. Pat. Nos. 3,662,423 by Miller; 3,237,235 by Moody; and 1,511,807 by Garner et al. Other variations of this tool are known within the industry, such as that represented on page 112 of the publication *American Builder,* issued August 1965.

Although jointer tools have been developed which do not include a carriage or wheel assembly (see U.S. Pat. No. 4,432,115) most masons prefer the combination of joint raker with carriage because of its improved efficiency. The wheels quickly roll along the brick face and properly position the raking tool (nail head) within the joint at its preselected depth. If the wheels are removed, the mason must attempt to maintain proper depth control by free hand, which typically requires greater time and energy. In such a highly competitive market, it is difficult to justify the extra time and effort required when streamlined devices such as a carriage-supported jointer tool are available.

Nevertheless, the use of the carriage and jointer tool combination has limitations. Because the joint raking tool needs to be near the contacting rim of the wheels mounted on the carriage, there is a limitation with respect to accessing corner joints. For example, where two walls abut at approximately ninety degrees, the joint raker tool has limited access to the corner formed by the abutting walls because of the blocking action of the carriage wheels. In other words, before the raker tool can advance into the corner, the carriage wheels strike against the abutting wall and prevent further access to loose mortar within the corner formed by such walls.

Typically, the mason will utilize a second tool referred to as a tuck pointer to remove mortar at the corner area. This tool resembles a screwdriver, whose end is inserted within the joint between the bricks for clearing mortar from the joint to the same depth as that developed by the joint raker. The need for changing hands between two tools becomes costly and irritating. Furthermore, the free hand motion required of the tuck pointer results in uneven joint facing within the corners as compared to the smooth joints formed by the carriage and joint raker.

OBJECTS AND SUMMARY OF THE INVENTION

It is therefore an object of the present invention to provide a masonry tool which provides for raking of unhardened mortar at the joint between courses of brick and can be utilized either along an open wall surface or within a corner area of restricted space.

It is a further object of this invention to provide a masonry tool which can function either as a joint raker or tuck pointer.

It is yet another object of this invention to provide a masonry tool which may be adapted for use as a tuck pointer or joint raker and is adapted to facilitate various depth settings or applications for the convenience of the mason.

These and other objects are realized in a masonry tool which comprises an elongated handle having upper and lower sides, a forward end and a terminal end. A rake and carriage assembly are attached to the forward end of the tool and project downward in orientation with respect to the lower side of the handle. This assembly includes a pair of wheels oriented for movement along a line substantially parallel with the longitudinal axis of the handle. The carriage includes means for supporting a first raking device which can be preset to a desired depth beyond a base rim of the wheels of the carriage. This enables the first raking device to drag loose mortar from the joint between adjacent courses of brick in a quick and efficient manner. A second raking device is attached at the terminal end of the handle and projects in an upward orientation with respect to the upper side of the handle. This orientation may be set to the same predetermined depth as that selected for the first raking device. In application, the mason advances the rake and carriage assembly along an open wall area of brick, applying the appropriate depth to the mortar joint. Upon approaching a closed area such as a corner, the mason merely flips his hand over, positioning the second raking device within the corner and inserted within the joint to an appropriate depth. This depth may be predetermined by the degree of projection of the second raking device beyond the surface of the terminal end of the handle. The mason can then drag the second raking device outward, clearing loose mortar from within the corner joint.

Other objects and features of the present invention will be apparent to those skilled in the art in view of the following detailed description, taken in combination with the accompanying drawings.

DESCRIPTION AND DRAWINGS

DETAILED DESCRIPTION OF THE INVENTION

Figure 1:
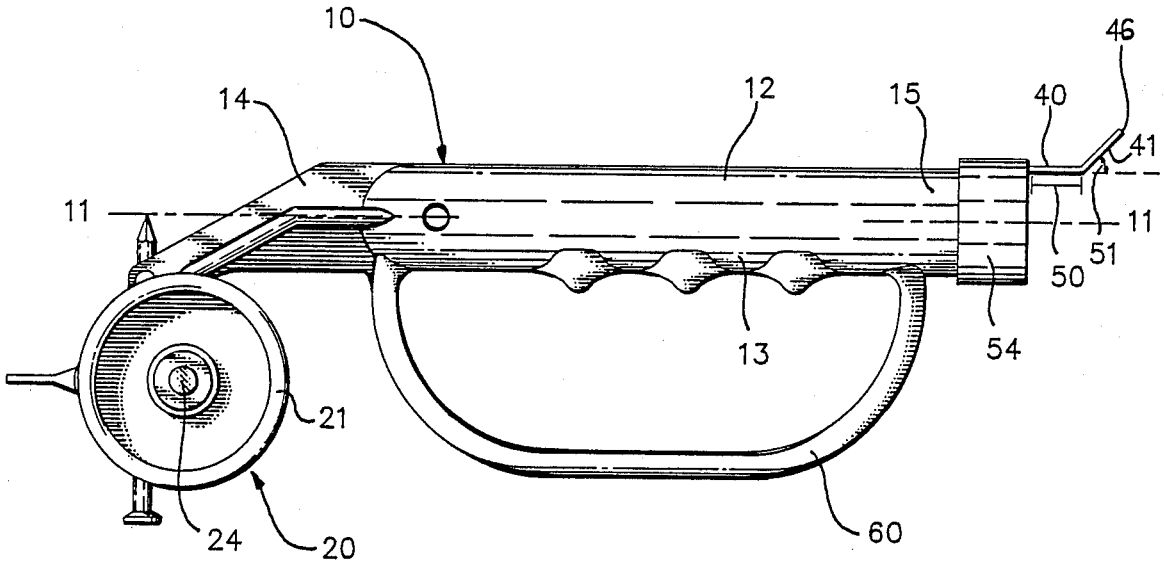
FIG. 1 shows a side view of a masonry tool constructed in accordance with the present invention.

Referring now to the drawings:

The subject masonry tool includes an elongated handle 10 which has a longitudinal axis 11 and includes an upper side 12 and a lower side 13. A forward end 14 and terminal end 15 define the extremities of the elongated handle 10. Although the handle may assume a variety of configurations, a straight configuration as illustrated is preferred for reasons which will be explained hereafter.

A rake and carriage assembly 20 are provided and coupled to the forward end 14 of the handle. This assembly includes a pair of wheels 21 and 22 which are oriented for movement along a line substantially parallel with the longitudinal axis 11. This carriage includes a support collar 23 through which an axle 24 is journaled and which provides rotational support to wheels 21 and 22.

In addition, the collar 23 includes a tubular opening 25 which extends vertically from a top face 26 of the shoulder to a bottom face 27 at the base of the carriage. This opening houses a nail 28 which operates as a first raking device. Specifically, the head 29 of the nail is adapted for dragging within a joint between courses of brick to scrape and drag loose mortar to a predetermined depth within the joint of the bricks. Selection of this depth is accomplished by adjusting the relative position of the nail 28 along a vertical orientation such that the nail head 29 is positioned at the desired depth of mortar within the joint, assuming contact between a base rim 30 of the wheels and a brick face 31. This position is fixed by a threaded locking pin 32 which restrains the nail 28 from further movement.

It will be apparent to those skilled in the art that other carriage assemblies may be applied within this invention which accomplish the inventive objects hereafter set forth. The intent is to include a joint raker and carriage assembly which can be useful in traversing action across the open face of a wall and wherein the terminal portion or nail head 29 can be selectively adjusted to operate at the appropriate depth.

A second raking device 35 is attached at the terminal end 15 and projects in an upward orientation with respect to the upper side 12 of the handle. The extended projection 37 is selected to correspond with the depth of projection 38 of the first raking device within the brick joint.

One embodiment of the second raking device 35 includes a first segment 40 which projects beyond the terminal end 15 of the handle and at least partially along the longitudinal axis 11. A second segment 41 is an elbow portion which is bent in a manner to extend the end thereof 46 at the desired radial distance and predetermined depth 37.

Figure 3:
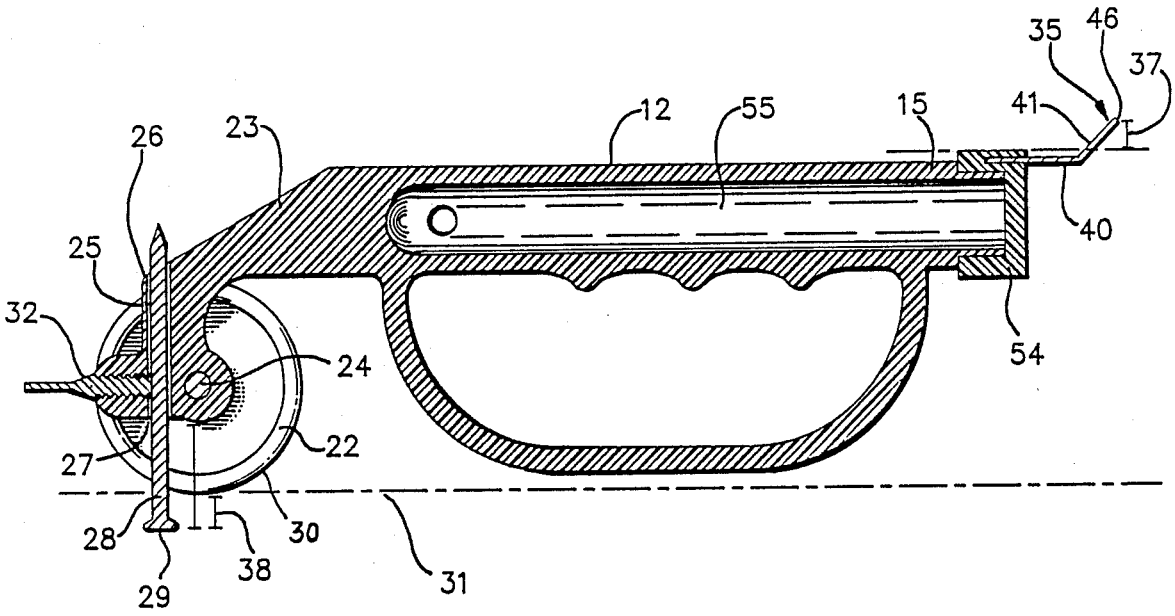
FIG. 3 shows a cross section taken along the lines 2—2 of FIG. 2.
Figure 4:
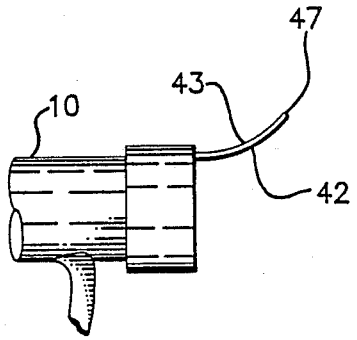
FIG. 4 shows a terminal section of the subject device with an arcuate element as the tuck pointer.

FIG. 4 illustrates an alternate embodiment of the second raking device which comprises an arcuate section 42 which is concave 43 with respect to the handle 10. This is in contrast to the linear configuration illustrated in FIGS. 1, 2 and 3 wherein the respective segments 40 and 41 are substantially straight.

Figure 5:
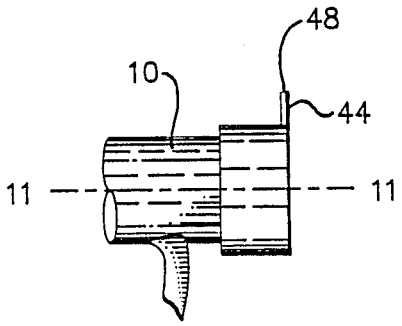
FIG. 5 illustrates a further embodiment having a radial projecting element as the tuck pointer.

FIG. 5 illustrates a second raking device 44 which projects radially from the terminal end of the handle at an orientation substantially perpendicular with the longitudinal axis 11. Accordingly, these three variations are representative of the types of raking devices which can serve as a tuck pointer directly attached to the terminal end 15 of the elongated handle 10. This enables the same device which was utilized for joint raking and open wall area to be applied in corners which are not otherwise accessible. The distal end 46, 47 and 48 of the second raking device 35, 43 or 44 can be positioned within the joint at a corner or at another site where the carriage assembly cannot obtain access. The loose mortar is extracted by pulling the handle and its attached second raker device along the joint channel, dragging the mortar free from the wall.

Figure 2:
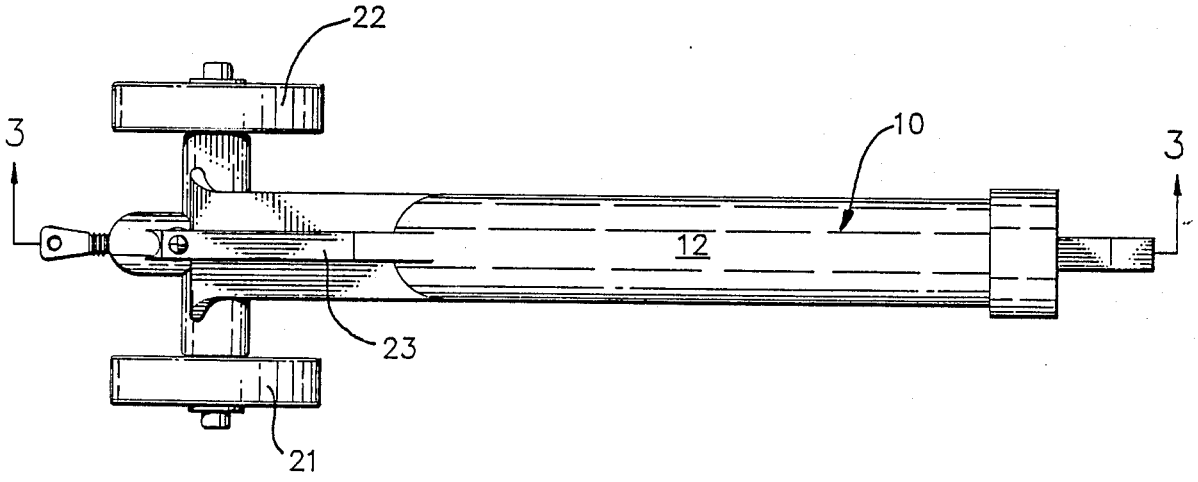
FIG. 2 shows a top view of the device illustrated in FIG. 1.

Of the three configurations, the preferred configuration is believed to be that illustrated in FIGS. 1, 2 and 3 wherein the tuck pointer extends axially from the terminal end of the handle and substantially along the longitudinal axis for distance 50 of at least one centimeter, with the elbow segment projecting at an angle 51 of at least 30 degrees with respect to the longitudinal axis to position the distal end 42 at the appropriate predetermined depth. As is illustrated in FIG. 2, the distal end 42 is squared with respect to the longitudinal axis 11 to provide a flat face within the joint.

This embodiment is further illustrated with a removable end cap 54 which is rotatable with respect to the handle and encloses an internal cavity 55 which provides a storage area for additional nails and hardware. This rotational mount of the end cap with attached tuck pointer 35 allows quick adjustments for reaching difficult areas to be scraped with the tuck pointer. In this configuration, the mason can quickly rotate the tuck pointer to any one of 360 degrees with respect to the longitudinal axis 11. This facilitates access to difficult corners requiring the mason to reach inward to use the device.

An additional feature of the present invention includes a hand guard 60 which is attached at the lower face 13. This hand guard is useful to protect the mason from striking his hand and knuckles against the brick surface as the device is being used.

Although various embodiments of the subject invention have been set forth in some detail, it is to be understood that the scope of the invention is not to be limited by the specific examples provided, but shall be construed in accordance with the following claims.

I claim:

1. A masonry tool for taking unhardened mortar at a predetermined depth between courses of brick, said tool comprising:

an elongated handle having a longitudinal axis, an upper side, an opposing lower side, a forward end and a terminal end;

a rake and carriage assembly attached to the forward end of the tool and projecting downward in orientation with respect to the lower side of the handle, said assembly including (i) a pair of wheels oriented for movement along a line substantially parallel with the longitudinal axis and (ii) means for supporting a first raking device at a predetermined depth beyond a base rim of the wheels such that a terminal portion of the raking device may project into a joint separating adjacent bricks as the wheels roll across an exposed face thereof to enable the terminal portion to drag loose mortar from the joint at the predetermined depth;

a cap member rotatably attached to the terminal end of said handle such that the cap can be rotated about the longitudinal axis; and a second raking device attached to the rotatable cap on the handle to thereby enable a user to rake joints at narrow corners and other confined spaces which are too small for the carriage assembly to access.

2. A tool as defined in claim 1, wherein the second raking device projects radially from the terminal end of the handle at an orientation substantially perpendicular with the longitudinal axis.

3. A tool as defined in claim 1, wherein the second raking device projects beyond the terminal end of the handle and at least partially along the longitudinal axis and includes a bent portion having a distal end positioned at the predetermined depth.

4. A tool as defined in claim 3, wherein the bent portion comprises an arcuate section of the raking device which is concave with respect to the handle.

5. A tool as defined in claim 3, wherein the bent portion comprises linear configuration which includes an elbow extending the distal end to the desired predetermined depth position.

6. A tool as defined in claim 3, wherein the position of the distal end is displaced beyond the terminal end of the handle a distance of at least the approximate length of the predetermined depth.

7. A tool as defined in claim 1, wherein the second raking device comprises a tuck pointer which extends axially from the terminal end of the handle and substantially along the longitudinal axis for a distance of at least 1 centimeter and bends at an elbow of at least 30 degrees with respect to the longitudinal axis and includes a distal end positioned at the predetermined depth.

8. A tool as defined in claim 7, wherein the distal end is squared with respect to the longitudinal axis.

9. A tool as defined in claim 1, wherein the handle includes a hollow chamber accessible through an opening at the terminal end, said rotatable cap being configured to fit snugly over the opening.

10. A tool as defined in claim 1, wherein the upper side of the handle includes a linear glide surface positioned with respect to the second raking device, said glide surface being adapted for tracking along the joint to be raked thereby.

11. A tool as defined in claim 1, wherein the handle further includes a downwardly projecting hand guard attached at the lower side of the handle.

* * * * *